US007932869B2

(12) United States Patent
Han et al.

(10) Patent No.: US 7,932,869 B2
(45) Date of Patent: Apr. 26, 2011

(54) ANTENNA WITH VOLUME OF MATERIAL

(75) Inventors: Chulmin Han, San Diego, CA (US); Rowland Jones, Carlsbad, CA (US); Jeffrey Shamblin, San Marcos, CA (US); Sabastian Rowson, San Diego, CA (US); Laurent Desclos, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 298 days.

(21) Appl. No.: 11/840,861

(22) Filed: Aug. 17, 2007

(65) Prior Publication Data

US 2009/0046028 A1 Feb. 19, 2009

(51) Int. Cl.
*H01Q 1/38* (2006.01)

(52) U.S. Cl. ..... 343/787; 343/873; 343/895

(58) Field of Classification Search ..... 343/700 MS, 343/702, 787, 873, 895, 741, 867, 872
See application file for complete search history.

(56) References Cited

U.S. PATENT DOCUMENTS 5,900,845 A * 5/1999 Mandai et al. ..... 343/895
5,903,240 A * 5/1999 Kawahata et al. ..... 343/700 MS
5,973,651 A * 10/1999 Suesada et al. ..... 343/752
6,456,243 B1 9/2002 Poilasne et al.
6,674,405 B2 * 1/2004 Wang ..... 343/700 MS
2004/0027286 A1 2/2004 Poilasne et al.
2005/0192727 A1 9/2005 Shostak et al.
2006/0220966 A1 10/2006 Sarychev et al.

OTHER PUBLICATIONS

International Search Report for PCT Application No. PCT/US2008/073612.

Rowson, "Optimized Performance When Integrating Multiple Antennas"; Antenna Systems & Technology, Sep./Oct. 2006, USA.

* cited by examiner

*Primary Examiner* — Michael C Wimer
(74) *Attorney, Agent, or Firm* — Coastal Patent Agency; Joshua S. Schoonover

(57) ABSTRACT

An antenna includes one or more antenna elements and a volume of material contained at least partly within a volume of the one or more antenna elements. The volume of material has at least one electromagnetic property that is different from free space. The volume of material may include dielectric material and/or ferrite material. The antenna elements may be isolated magnetic dipole (IMD) antenna elements. The electromagnetic property may be permeability and/or permittivity.

27 Claims, 8 Drawing Sheets

ANTENNA WITH VOLUME OF MATERIAL

BACKGROUND OF THE INVENTION

The present invention relates generally to the field of wireless communication. In particular, the present invention relates to an antenna for use within such wireless communication.

As handsets and other wireless communication devices become smaller and embedded with more applications, new antenna designs are required to address inherent limitations of these devices. With classical antenna structures, a certain physical volume is required to produce a resonant antenna structure at a particular radio frequency and with a particular bandwidth. In multi-band applications, more than one such resonant antenna structure may be required. With the advent of a new generation of wireless devices, such classical antenna structure will need to take into account beam switching, beam steering, space or polarization antenna diversity, impedance matching, frequency switching, mode switching, etc., in order to reduce the size of devices and improve their performance.

Wireless devices are also experiencing a convergence with other mobile electronic devices. Due to increases in data transfer rates and processor and memory resources, it has become possible to offer a myriad of products and services on wireless devices that have typically been reserved for more traditional electronic devices. For example, modern day mobile communications devices can be equipped to receive broadcast television signals. These signals tend to be broadcast at very low frequencies (e.g., 200-700 Mhz) compared to more traditional cellular communication frequencies of, for example, 800/900 Mhz and 1800/1900 Mhz.

SUMMARY OF THE INVENTION

In one aspect of the present invention, an antenna comprises one or more antenna elements and a volume of material contained at least partly within a volume of the one or more antenna elements. The volume of material has at least one electromagnetic property that is different from free space.

In one embodiment, the volume of material includes dielectric material.

In one embodiment, the volume of material includes ferrite material.

In one embodiment, at least one of the one or more antenna elements is formed around the volume of material.

In one embodiment, at least one of the one or more antenna elements is formed within the volume of material.

In one embodiment, at least one of the one or more antenna elements is an isolated magnetic dipole antenna element.

In one embodiment, the electromagnetic property is permeability.

In one embodiment, the electromagnetic property is permittivity.

In one embodiment, the volume of material includes two or more portions with differing electromagnetic properties. The two or more portions may be layers of materials. The layers may be configured parallel to each of the one or more antenna elements. Alternatively, the layers may be configured perpendicular to at least one of the one or more antenna elements.

In one embodiment, at least one layer includes a dielectric material with a differing electromagnetic property from any adjacent layers. At least a part of one layer may include a ferrite material.

In one embodiment, at least one antenna element is formed on one layer, and the antenna further comprises a matching circuit formed on a different layer than the at least one antenna element.

In one embodiment, the two or more portions provide a three-dimensional variability in the electromagnetic property.

In one embodiment, the volume of material includes a two-dimensional variability in the electromagnetic property.

In one embodiment, the volume of material includes a three-dimensional variability in the electromagnetic property.

In one embodiment, the one or more antenna elements includes an isolated magnetic dipole (IMD) element, the IMD element having a slot region positioned on a first surface of the volume of material and a tuning region positioned on a second surface of the volume of material. The antenna may further comprise a dielectric loading in the slot region of the IMD element, the dielectric loading having an electromagnetic property that is different from the volume of material. In one embodiment, the antenna further comprises a second dielectric loading in the tuning region of the IMD element, the second dielectric loading having an electromagnetic property that is different from the volume of material.

In one embodiment, the antenna further comprises a ground plane on which the volume of material is positioned. The ground plane may include a matching circuit incorporated therein. The ground plane may be a circuit board of a communication device. In one embodiment, the volume of material is positioned in a region of the circuit board from which metallization has been removed. In another embodiment, the volume of material is positioned in a metallized region of the circuit board.

In another aspect, the invention relates to a communication device comprising a housing and an antenna. The antenna comprises one or more antenna elements and a volume of material contained at least partly within a volume of the one or more antenna elements, wherein the volume of material has at least one electromagnetic property that is different from free space.

DETAILED DESCRIPTION OF THE PREFERRED EMBODIMENTS

Figure 1:
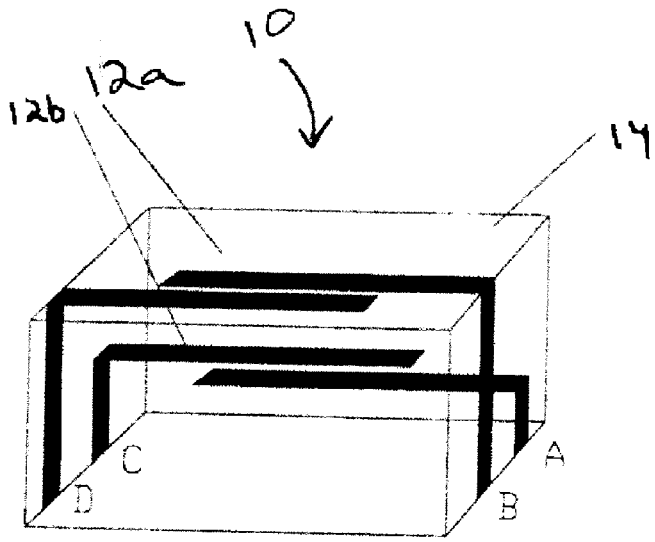
FIG. 1 illustrates an antenna according to an embodiment of the present invention.

Antennas using an isolated magnetic dipole element (IMD) have been implemented in numerous devices. Such antennas can provide very good coverage while maintaining a small form factor. Antennas with an IMD element typically provide the IMD element as positioned above a ground plane.

Rather than forming such antennas with free space around the IMD element, embodiments of the present invention reduce the size of such antennas by modifying certain material properties surrounding the antenna or the IMD element. Specifically, in accordance with embodiments of the present invention, electromagnetic properties, such as permittivity and permeability, are varied around the IMD element to achieve the desired result. By changing material properties of sections or layers of a volume of material, antenna parameters such as bandwidth and efficiency can be optimized or improved as the overall size is reduced.

The electromagnetic properties of materials, such as permeability and permittivity, can be understood by examination of propagation of waves. The wavelength of a wave propagating in through a dielectric material decreases compared to free space propagation. In free space, the wavelength and frequency of a wave are related by:

$$c=f\lambda \tag{1}$$

where:

c=speed of light (meters/second), f=frequency in Hertz (1/second), and $\lambda$=wavelength (meters).

The following equation (derived directly from Maxwell's equations) relates the speed of light to the permittivity and permeability of free space:

$$c=1/(\in_0\mu_0)^{1/2} \tag{2}$$

where:

$\in_0$=permittivity of free space=$8.8542\times10^{-12}$ Farad/meter, and $\mu_0$=permeability of free space=$4\pi\times10^{-7}$ Henry/meter.

From the units associated with the permittivity (Farads per meter), it can be noted that the permittivity describes the effect the material will have on the electric field component of the electromagnetic wave. With units of Henrys per meter, the permeability relates to the magnetic properties of the material. In electromagnetics, where there are traveling waves, the permittivity (partially defined by the dielectric constant of the material) and the permeability quantify the ability of a material to store electric and magnetic energy, respectively.

The wavelength can be related to permittivity (dielectric constant) by combining equations (1) and (2) above:

$$f\lambda=1/(\in_0\mu_0)^{1/2} \tag{3}$$

$$\lambda=1/(f(\in_0\mu_0)^{1/2}). \tag{4}$$

When an electromagnetic wave travels in a dielectric material, the permittivity of free space is not applicable. Rather, the permittivity associated with the dielectric material should be used. The permittivity of a material is quantified as:

$$\in=\in'-j\in'' \tag{5}$$

where:

$\in$=permittivity, $\in'$=dielectric constant, and $\in''$=imaginary part of permittivity.

The loss tangent, tan $\delta$, of a material is defined as:

$$\tan\delta=\in''/\in' \tag{6}$$

If the material is lossless (i.e., loss tangent=0), the permittivity is just the dielectric constant. Because the permittivity of free space is such a small number, the dielectric constant of a material is more easily expressed as a relative dielectric constant:

$$\in_r=\in'/\in_0 \tag{7}$$

where:

$\in_r$=relative dielectric constant.

Similarly, the permeability of a material can be expressed as a relative permeability:

$$\mu_r=\mu'/\mu_0 \tag{8}$$

where:

$\mu_r$=relative permeability, and $\lambda'$=permeability of a material.

Non-magnetic materials have a permeability equal to that of free space. Therefore, the relative permeability of such materials is: $\mu_r$=1.0. For lossless (i.e., magnetic loss tangent=0), non-magnetic materials, the wavelength in the material can be expressed as:

$$\lambda_m=1/(f(\in'\mu')^{1/2})=1/(f(\in'\mu_0)^{1/2}). \tag{9}$$

The change in wavelength of a wave in a volume of material compared to that in free space can be determined by dividing equation (9) by equation (4) to obtain:

$$\lambda_m=\lambda/\sqrt{\in_r} \tag{10}$$

Thus, the wavelength of an electromagnetic wave traveling in a volume of material with a dielectric constant of $\in_r$ can be determined.

In using such materials for antenna applications, a material may be selected to achieve the desired result for the specific frequency range of the antenna. For all but the low frequency applications (e.g., below 200 MHz), magnetic materials (ferrites) may result in significant losses. Accordingly, for the higher-frequency antennas, use of magnetic materials should be avoided. Instead, for the higher-frequency antennas, the dielectric constant (the real part of the permittivity) of the volume surrounding the antenna can be increased above that of free space to decrease the physical size of the antenna. The dielectric constant may be varied over the volume to provide more flexibility in designing an efficient antenna.

For low-frequency antennas, increased permeability of a ferrite material can assist in reducing the frequency of operation of a wire antenna. At these lower frequencies, the losses associated with the ferrite material are acceptable.

Referring now to FIG. 1, an antenna 10 according to an embodiment of the present invention is illustrated. The antenna includes a number of antenna elements 12*a*, 12*b*. In the illustrated embodiment, the antenna elements 12*a*, 12*b* are isolated magnetic dipole (IMD) antenna elements. IMD elements provide greater isolation through confinement of the electromagnetic currents on the antenna. The isolation allows for increased bandwidth, reduced antenna size and low emissions.

In the embodiment illustrated in FIG. 1, two antenna elements 12*a*, 12*b* are provided. In this regard, each antenna element 12*a*, 12*b* may be adapted for coverage of a different frequency range. Thus, the antenna 10 may be configured as a multi-band antenna or an antenna with greater frequency bandwidth. In other embodiments, any practical number of antenna elements may be provided to cover various frequency ranges.

The antenna 10 of FIG. 1 includes a volume of material 14. The volume of material 14 may include a material which has at least one electromagnetic property that is different from free space. For example, the permittivity, permeability or both of the volume of material 14 may be different from that of free space. In various embodiments of the invention, the volume of material 14 may include either a dielectric material or a ferrite material. As noted above, for a higher-frequency antenna, a dielectric material is desirable, while for a low-frequency antenna, a ferrite material may be used. FIG. 1 illustrates an antenna 10 configured for use as a higher-frequency antenna, and, accordingly, the volume of material 14 includes a dielectric material.

The volume of material 14 is contained at least partly within a volume of one or more antenna elements 12*a*, 12*b*. Thus, at least the interior volume defined by each of the antenna elements 12*a*, 12*b* includes part of the volume of material 14. In the illustrated embodiment, one antenna element 12*a* is formed around the volume of material 14. Thus, the volume of material 14 is substantially completely contained within a volume of the antenna element 12*a*. The second antenna element 12*b* is formed within the volume of material 14. Thus, only a part of the volume of material 14 is contained within the volume of the second antenna element 12*b*.

In the embodiment illustrated in FIG. 1, the volume of material 14 is configured as a rectangular box. Those with skill in the art will understand that many other shapes may be used and are contemplated within the scope of the present invention.

Thus, compared to an antenna with free space, the antenna 10 illustrated in FIG. 1 can provide the same frequency bandwidth while presenting a smaller form factor.

Figure 2:
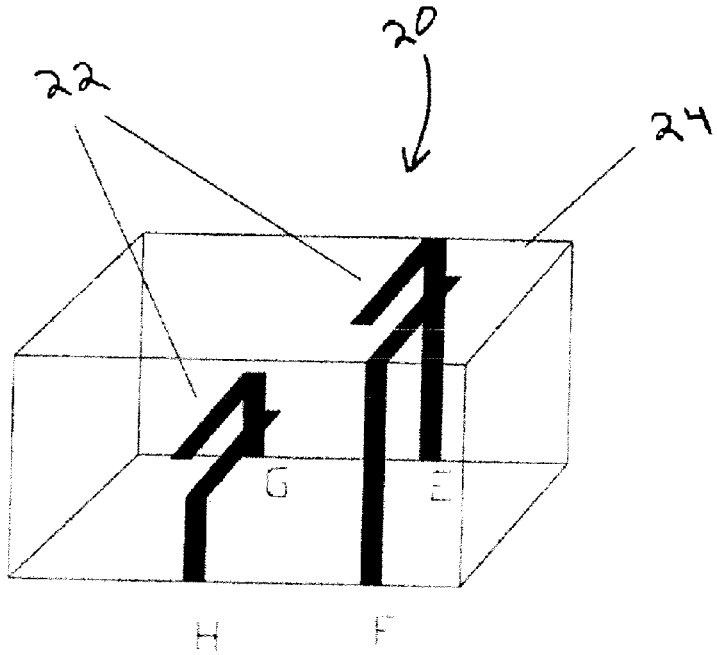
FIG. 2 illustrates an antenna according to another embodiment of the present invention.

FIG. 2 illustrates an antenna 20 according to another embodiment of the present invention. The antenna 20 of FIG. 2 is similar to that illustrated in FIG. 1 and described above. The antenna 20 includes antenna elements 22 formed on and within a volume of dielectric material 24. The antenna 20 illustrated in FIG. 2 is formed in an alternate orientation from the antenna 10 illustrated in FIG. 1.

Figure 3:
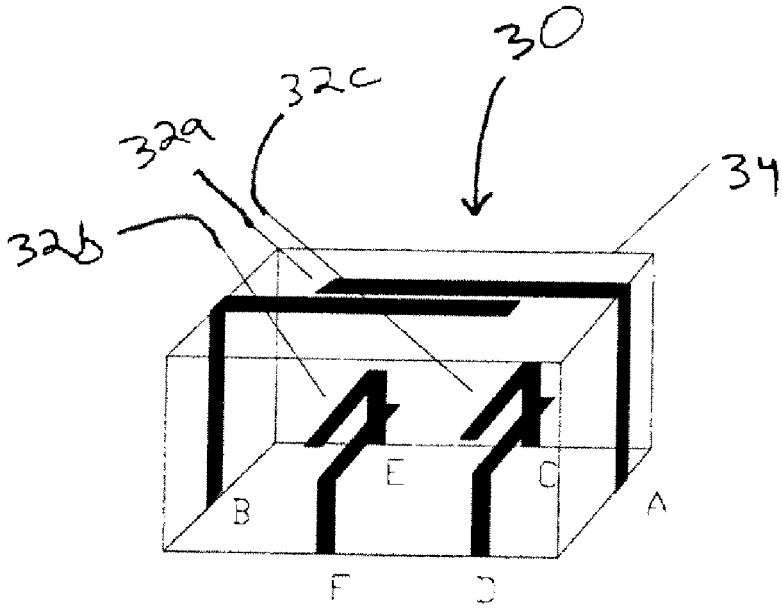
FIG. 3 illustrates an antenna with antenna elements configured in various orientations according to an embodiment of the present invention.

As noted above, an antenna according to an embodiment of the present invention may include any practical number of antenna elements. In this regard, FIG. 3 illustrates an antenna 30 with three antenna elements 32 and a volume of material 34. The three antenna elements 32 may provide greater frequency bandwidth or additional frequency ranges for the antenna. Additionally, whereas the antenna elements in the embodiments of FIGS. 1 and 2 are oriented parallel to each other, the antenna 30 of FIG. 3 includes antenna elements with varying orientations. In this regard, the antenna elements 32*b* and 32*c* are oriented perpendicular to the antenna element 32*a*.

Figure 4:
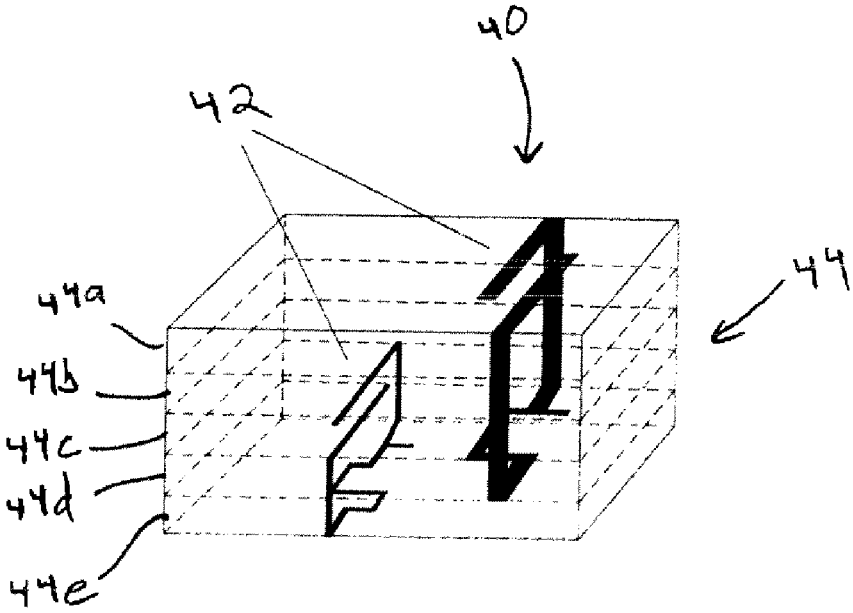
FIG. 4 illustrates an antenna with multiple layers of material according to an embodiment of the present invention.

In various embodiments of the present invention, the volume of material may include two or more portions with differing electromagnetic properties, such as permittivity or permeability. For example, as illustrated in FIG. 4, an antenna 40 may include a volume of material 44 which includes layers of materials 44*a-e*. Each layer of material 44*a-e* may have a material with a differing electromagnetic property from any adjacent layers. For example, the permittivity of a dielectric material in the bottom layer 44*e* may be different from the permittivity of the dielectric material in the fourth layer 44*d*. The layers may be the same or different in size. For example, the thickness of the first layer 44*a* may be significantly greater than the thickness of each of the other layers 44*b-e*. Antenna elements 42 may be formed between the various layers 44*a-e*.

In the embodiment illustrated in FIG. 4, discrete layers of materials having different dielectric constants are formed. In other embodiments, a substantially continuous change in the dielectric constant may be implemented, thereby forming a gradient in the dielectric constant.

Figure 5:
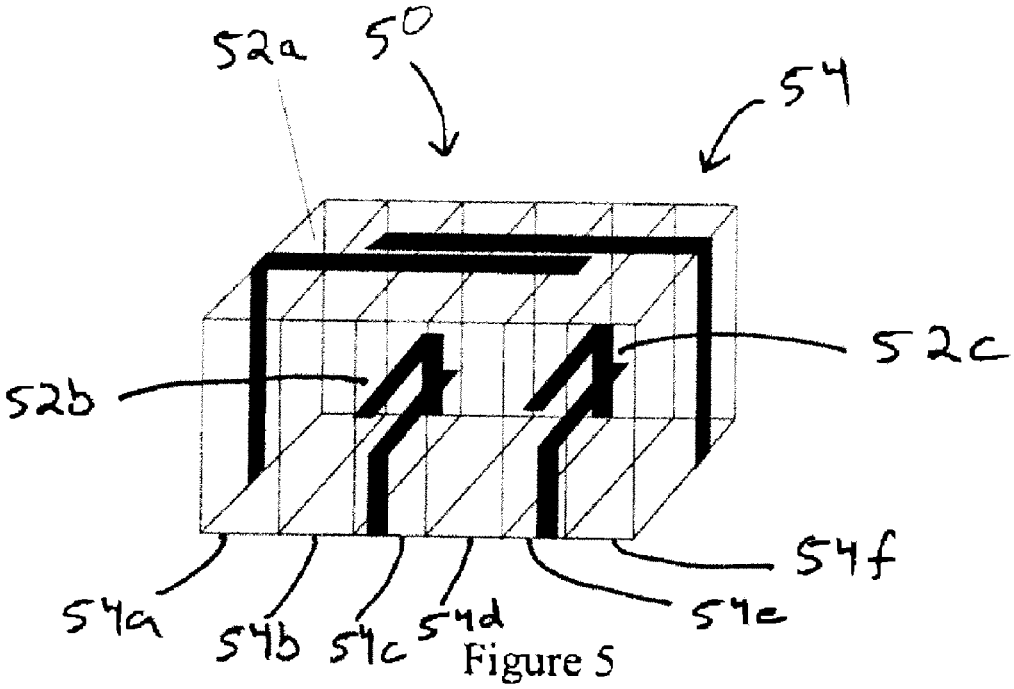
FIG. 5 illustrates an antenna with layers of material configured in a different orientation according to an embodiment of the present invention.

In the embodiment illustrated in FIG. 4, the layers of materials 44*a-e* are configured parallel to each of the antenna elements 42. In other embodiments, the layers may be configured in other orientations. For example, FIG. 5 illustrates an embodiment of an antenna 50 in which the volume of material 54 includes layers 54*a-f* which are configured perpendicular to at least one of the antenna elements. Thus, the layers 54*a-f* are oriented perpendicular to the antenna element 52*a*. In this regard, the antenna element 52*a* traverses multiple layers 54*a-f*.

Figure 6:
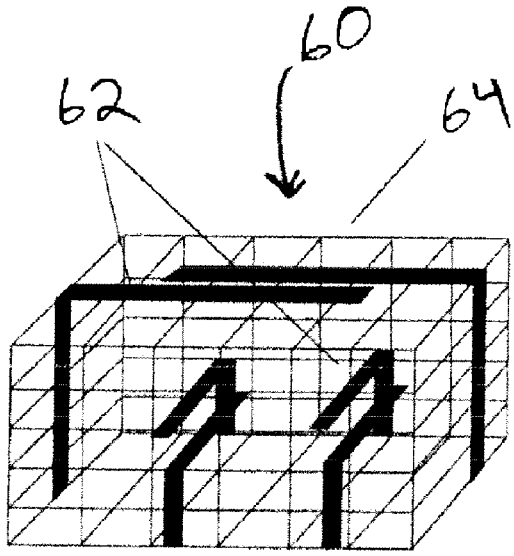
FIG. 6 illustrates an antenna with a volume of material having a three-dimensional variation according to an embodiment of the present invention.

FIG. 6 illustrates an embodiment of an antenna 60 in accordance with the present invention in which the volume of material 64 is divided into portions to provide a three-dimensional variability in permeability or permittivity. The antenna elements 62 may be formed on or within the volume of material 64. In the embodiment illustrated in FIG. 6, discrete portions of materials having different dielectric constants are formed. In other embodiments, a substantially continuous, three-dimensional variability in the dielectric constant may be implemented, thereby forming a three-dimensional gradient in the dielectric constant.

Figure 7:
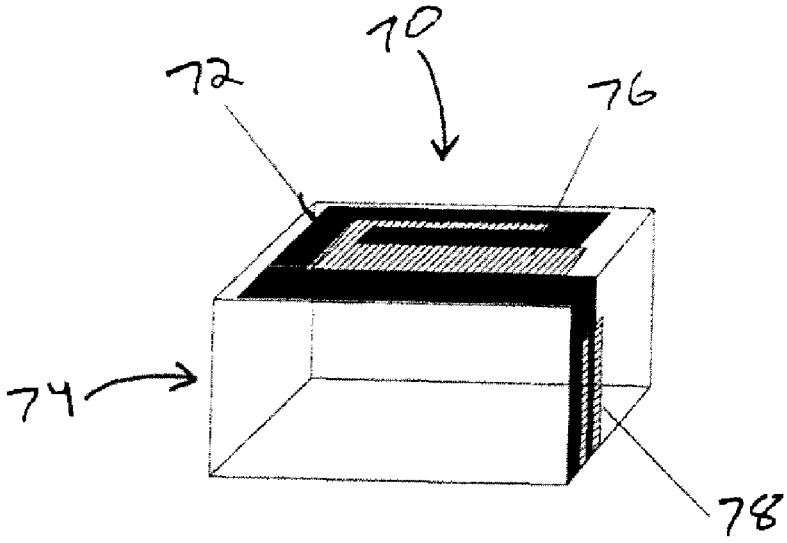
FIG. 7 illustrates an antenna with dielectric loading according to another embodiment of the present invention.

FIG. 7 shows an antenna 70 according to another embodiment of the present invention. The antenna 70 includes an IMD antenna element 72 formed on a volume of material 74, which may be dielectric material or ferrite material. The IMD antenna element 72 includes a slot region 76 positioned on the top surface of the volume of material 74. Additionally, a tuning region 78 is positioned on a side surface of the volume of material 74. In order to provide increased flexibility in the design of the antenna 70, a dielectric loading is provided in the slot region. The dielectric loading provides a varied electromagnetic property in relation to the electromagnetic properties across the rest of the volume of material 74. Thus, a reduced dielectric constant region in the slot region 76 can increase the bandwidth of the antenna. Alternately, an increased dielectric constant section in the slot region 74 can be implemented to reduce the resonant frequency of the IMD antenna, which will allow for a reduction in antenna size. Similar dielectric loading may be provided in the tuning region 78. In other embodiments, such as for low-frequency antennas, the volume of material may be a ferrite material and the slot region 74 and/or the tuning region 78 may be ferrite loaded.

Figure 8:
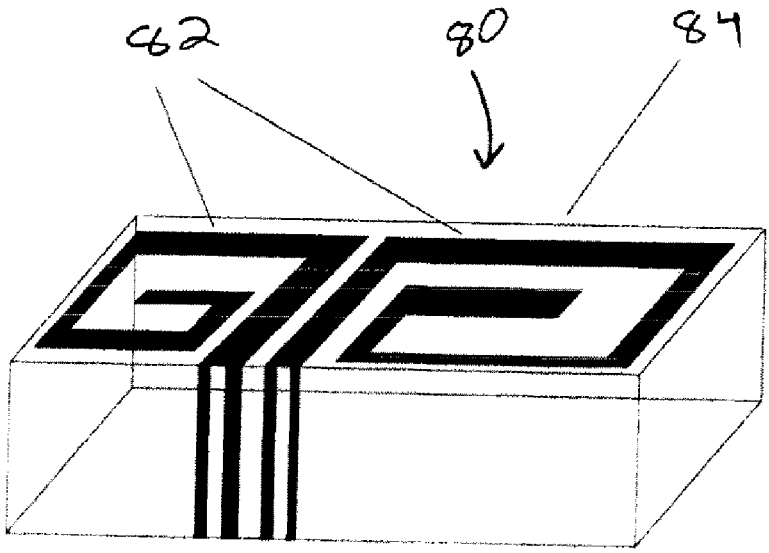
FIG. 8 illustrates another antenna according to an embodiment of the present invention.

FIG. 8 illustrates an antenna 80 according to an embodiment of the present invention with multiple IMD antenna elements 82 positioned on the surface of a dielectric volume 84. The unique attributes of the IMD antenna elements along with the dielectric properties of the volume of material provide for good isolation. Thus, the IMD antenna elements 82 can be closely spaced. Each of the multiple IMD antenna elements 82 can be sized or otherwise configured differently to provide coverage for a different frequency range. Thus, multiple IMD antenna elements can allow an antenna to be easily configured as a multi-frequency antenna or an antenna with greater frequency bandwidth.

Figure 9:
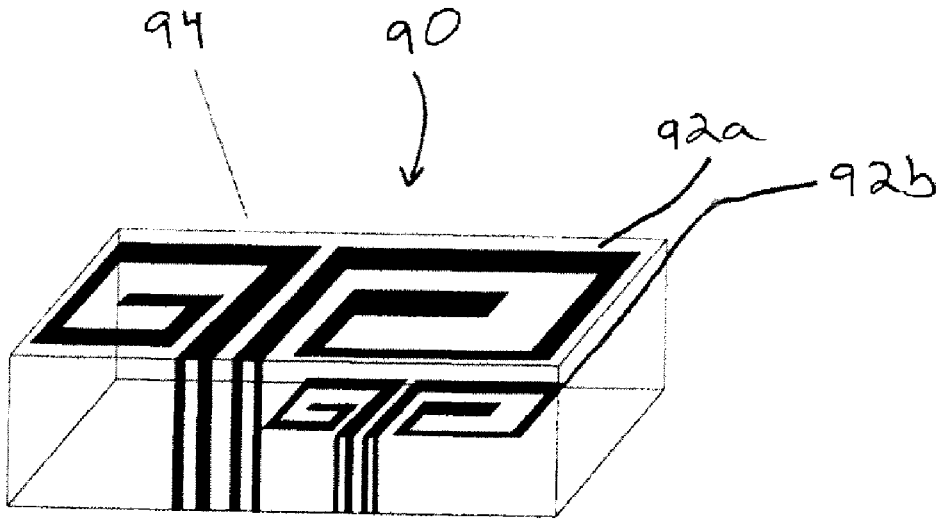
FIG. 9 illustrates another antenna according to an embodiment of the present invention

Similarly, as illustrated in FIG. 9, certain embodiments of the antenna 90 may include a volume of dielectric material 94 with multiple IMD antenna elements 92*a*, 92*b* on the surface and within the volume of dielectric material 94.

Figure 10:
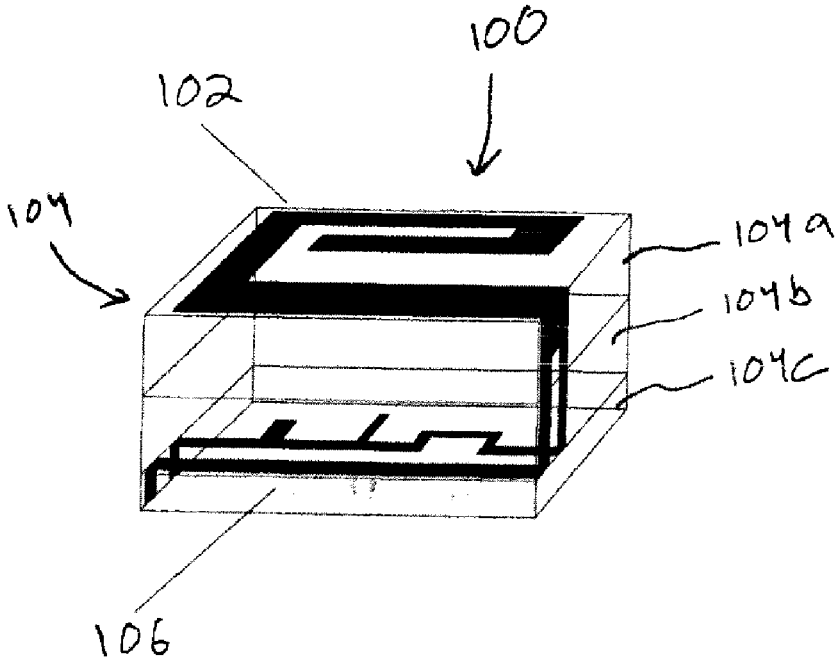
FIG. 10 illustrates an antenna with a matching circuit according to an embodiment of the present invention.

FIG. 10 illustrates an antenna 100 according to another embodiment of the present invention. The antenna 100 includes a volume of material 104, such as dielectric material, which includes layers 104*a-c* of material having differing electromagnetic properties, such as varying permittivity. An IMD antenna element 102 is formed on the surface of the volume of material 104. Additionally, a matching circuit 106 is formed on one layer 104*c*, while the IMD antenna element 102 is formed on another layer 104*a*. As noted above, the dielectric properties of the layer 104*c* supporting the matching circuit 106, the layer 104*a* supporting the IMD antenna element 102, and the intermediate layer 104*b* can vary. For example, an increased dielectric constant layer 104*c* for the matching circuit 106 allows for distributed matching components that are dependent on a specific electrical length. Further, a size reduction can be achieved in matching components that are dependent on electrical length, such as microstrip line stubs and phase delay lines.

Figure 11:
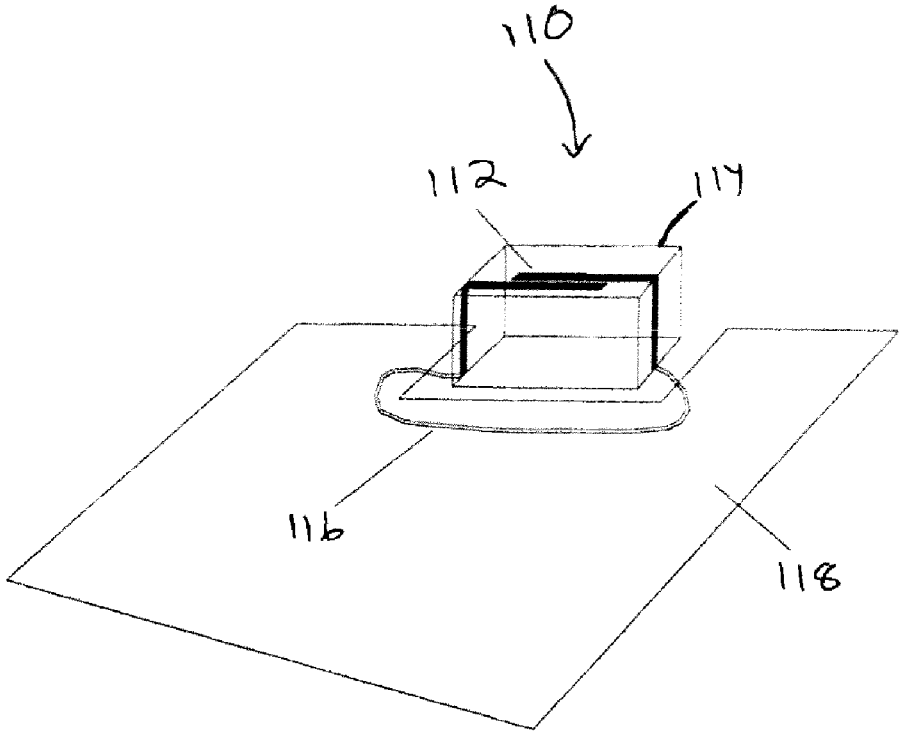
FIG. 11 illustrates an antenna with a ground plane according to an embodiment of the present invention.

FIG. 11 illustrates an antenna 110 according to another embodiment of the present invention. The antenna 110 includes an IMD antenna element 112 formed on a volume of dielectric material 114 positioned on a ground plane 118. A matching circuit 116 may be incorporated onto the ground plane 118. The ground plane 118 may be a circuit board of a communication device on which the antenna 110 is mounted. The antenna 110 can operate on an area of the ground plane 118 (or circuit board) where metallization has been removed. This area is illustrated in FIG. 11 as a cutout of the ground plane 118 on which the antenna 110 is positioned.

Figure 12:
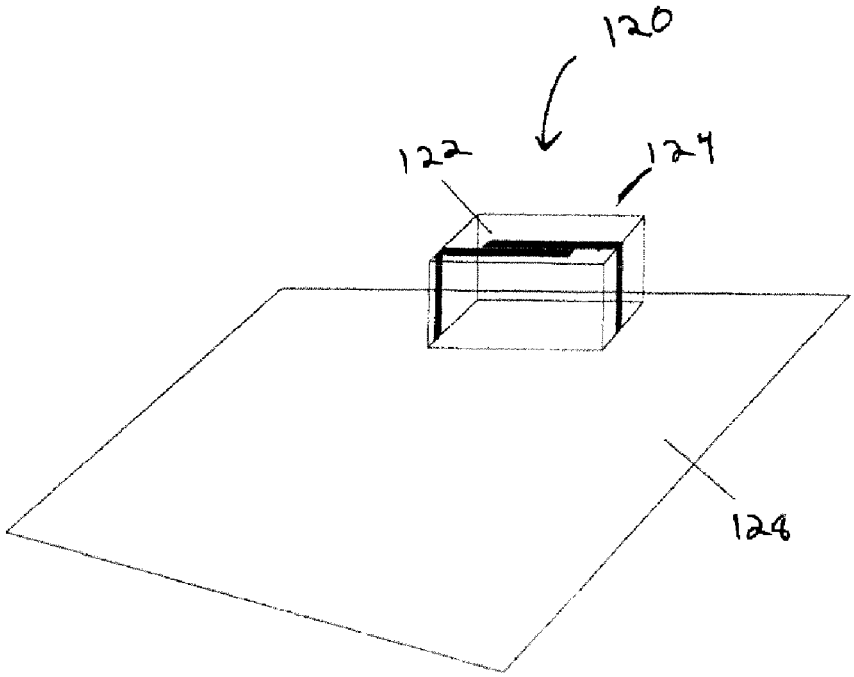
FIG. 12 illustrates another antenna with a ground plane according to an embodiment of the present invention.

In another embodiment, illustrated in FIG. 12, an antenna 120 having an IMD antenna element 122 formed on a volume of dielectric volume 124 is positioned on a ground plane 128. As with the embodiment of FIG. 11 described above, the antenna 120 may have a matching circuit incorporated onto the ground plane 128 structure. In the embodiment of FIG. 12, the antenna 120 can operate on a metallized area of the ground plane (or circuit board).

Figure 13:
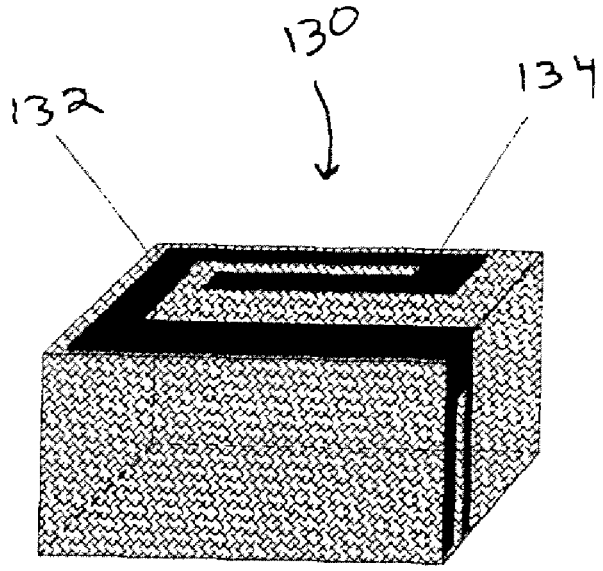
FIG. 13 illustrates an antenna according to an embodiment of the present invention with the volume of material including ferrite material.

As noted above, the volume of material may be selected for specific electromagnetic properties and the desired application. For low-frequency antenna applications, the material in the volume of material may be a ferrite material. FIG. 13 illustrates a low-frequency antenna according to an embodiment of the present invention. The antenna 130 includes an IMD antenna element 132 formed on the surface of a volume of material 134. The volume of material 134 includes a ferrite material. Placing the IMD antenna element 132 on a volume of ferrite material allows reduction of the frequency of operation. Further, although each of the embodiments of FIGS. 1-12 are illustrated with a volume of material include a dielectric material, each of the embodiments of FIG. 1-12 may be configured with a ferrite material in the volume of material for certain applications.

Figure 14:
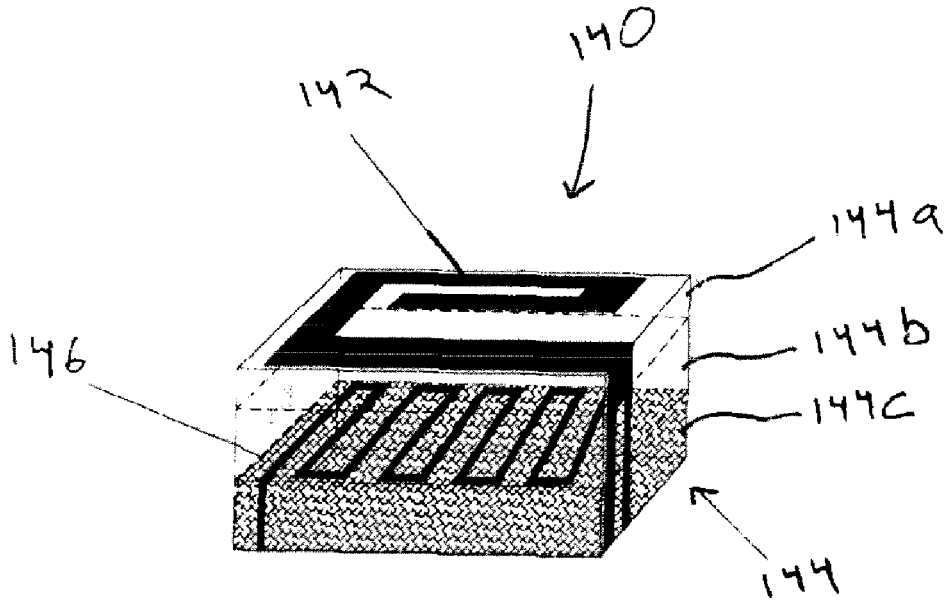
FIG. 14 illustrates an antenna according to an embodiment of the present invention with the volume of material including dielectric material and ferrite material.

In further embodiments, the volume of material may include a combination of dielectric material and ferrite material. FIG. 14 illustrates an antenna 140 in which the volume of material 144 includes layers of materials 144*a-c*. At least a part of one layer includes a ferrite material. For example, while the top two layers 144*a*, 144*b* include a dielectric material, the bottom layer 144*c* includes a ferrite material. The antenna 140 includes an IMD antenna element 142 formed on the top layer 144*a* to provide high-frequency coverage. Further, a second antenna element 146 may be positioned between the second layer 144*b* (dielectric material) and the third layer 144 (ferrite material) to provide low frequency. Thus, the antenna 140 is configured to support a larger frequency bandwidth or may be configured as a multi-frequency bandwidth. In this regard, a very low frequency antenna and a high frequency antenna may be provided in the same small structure.

Figure 15:
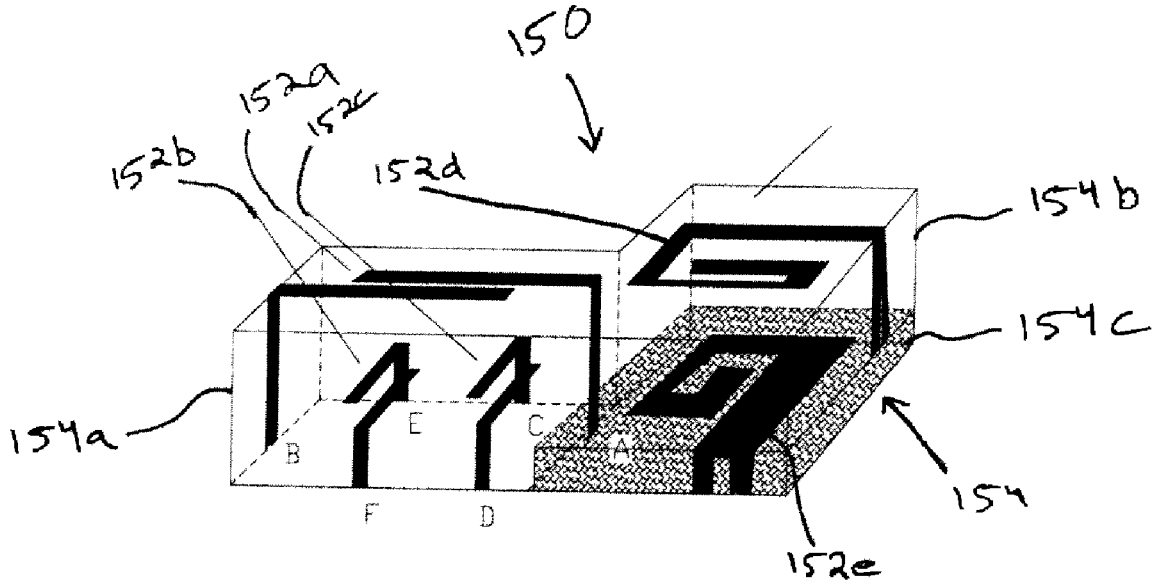
FIG. 15 illustrates another antenna according to an embodiment of the present invention with the volume of material including dielectric material and ferrite material.

As noted above, the volume of material is not limited to any particular shape. In this regard, FIG. 15 illustrates a combination of dielectric and ferrite materials in an arbitrary-shaped volume with antennas incorporated in or on both material types. The antenna 150 includes multiple antenna elements 152*a-e* formed on or within a volume of material 154. The volume of material 154 includes a first portion including a single layer 154*a* of dielectric material and a second portion including a layer 154*b* of dielectric material and a layer 154*c* of ferrite material.

Thus, in accordance with embodiments of the present invention, antennas may be provided with greater design flexibility and more efficient form factors.

While particular embodiments of the present invention have been disclosed, it is to be understood that various different modifications and combinations are possible and are contemplated within the true spirit and scope of the appended claims. There is no intention, therefore, of limitations to the exact abstract and disclosure herein presented.

What is claimed is:

1. An antenna, comprising:

one or more antenna elements; and a volume of material contained at least partly within a volume of the one or more antenna elements, wherein the volume of material has at least one electromagnetic property that is different from free space, and wherein said antenna elements include an isolated magnetic dipole element having a slot region positioned on a first surface of the volume of material and a tuning region positioned on a second surface of the volume of material; and wherein a dielectric loading is contained within at least one of said slot region and said tuning region of the isolated magnetic dipole antenna, the dielectric loading having an electromagnetic property that is different from the volume of material.

2. The antenna of claim 1, wherein the volume of material includes dielectric material.

3. The antenna of claim 1, wherein the volume of material includes ferrite material.

4. The antenna of claim 1, wherein at least one of the one or more antenna elements is formed around the volume of material.

5. The antenna of claim 1, wherein at least one of the one or more antenna elements is formed within the volume of material.

6. The antenna of claim 1, wherein the electromagnetic property is permeability.

7. The antenna of claim 1, wherein the electromagnetic property is permittivity.

8. The antenna of claim 1, wherein the volume of material includes two or more portions with differing electromagnetic properties.

9. The antenna of claim 8, wherein the two or more portions are layers of materials.

10. The antenna of claim 9, wherein the layers are configured parallel to each of the one or more antenna elements.

11. The antenna of claim 9, wherein the layers are configured perpendicular to at least one of the one or more antenna elements.

12. The antenna of claim 9, wherein at least one layer includes a material with a differing electromagnetic property from any adjacent layers.

13. The antenna of claim 12, wherein at least a part of one layer includes a ferrite material.

14. The antenna of claim 9, wherein at least one antenna element is formed on one layer, the antenna further comprising:

a matching circuit formed on a different layer than the at least one antenna element.

15. The antenna of claim 8, wherein the two or more portions provide a three-dimensional variability in the electromagnetic property.

16. The antenna of claim 1, wherein the volume of material includes a two-dimensional variability in the electromagnetic property.

17. The antenna of claim 1, wherein the volume of material includes a three-dimensional variability in the electromagnetic property.

18. The antenna of claim 1, further comprising a dielectric loading in the slot region of the isolated magnetic dipole element, the dielectric loading having an electromagnetic property that is different from the volume of material.

19. The antenna of claim 18, further comprising a second dielectric loading in the tuning region of the isolated magnetic dipole element, the second dielectric loading having an electromagnetic property that is different from the volume of material.

20. The antenna of claim 1, further comprising a dielectric loading in the tuning region of the isolated magnetic dipole element, the dielectric loading having an electromagnetic property that is different from the dielectric volume.

21. The antenna of claim 1, further comprising: a ground plane on which the volume of material is positioned.

22. The antenna of claim 21, wherein the ground plane includes a matching circuit incorporated therein.

23. The antenna of claim 21, wherein the ground plane is a circuit board of a communication device.

24. The antenna of claim 23, wherein the volume of material is positioned in a region of the circuit board from which metallization has been removed.

25. The antenna of claim 23, wherein the volume of material is positioned in a metalized region of the circuit board.

26. An antenna, comprising:

one or more antenna elements;

said antenna elements including an isolated magnetic dipole element having a slot region and a tuning region;

a dielectric loading in the slot region of the isolated magnetic dipole antenna element; and a volume of material contained at least partly within a volume of the one or more antenna elements, wherein the volume of material has at least one electromagnetic property that is different from free space;

wherein said dielectric loading has an electromagnetic property that is different from the volume of material.

27. The antenna of claim 26, further comprising a second dielectric loading in said tuning region of the isolated magnetic dipole element; the second dielectric loading having an electromagnetic property that is different from said volume of material.

* * * * *